US005590725A

United States Patent [19]

Blickhan

[11] Patent Number: 5,590,725

[45] Date of Patent: Jan. 7, 1997

[54] DRILLING COLUMN WITH SLEDGEHAMMER DRILLING HEAD

[76] Inventor: Franz Blickhan, Oberwaldstr. 12, D-64859 Eppertshausen, Germany

[21] Appl. No.: 530,176

[22] PCT Filed: Mar. 22, 1994

[86] PCT No.: PCT/EP94/00887

§ 371 Date: Sep. 29, 1995

§ 102(e) Date: Sep. 29, 1995

[87] PCT Pub. No.: WO94/23175

PCT Pub. Date: Oct. 13, 1994

[30] Foreign Application Priority Data

Apr. 2, 1993 [DE] Germany ..... 43 10 726.5

[51] Int. Cl.[6] ..... E21B 21/12; E21B 4/14; E21B 17/18; E21B 10/38

[52] U.S. Cl. ..... 175/100; 175/215; 175/393; 175/418; 285/133.1

[58] Field of Search ..... 175/215, 100, 175/65, 71, 393, 325.1, 320, 212, 418, 339, 340; 285/132, 133.1

[56] References Cited

U.S. PATENT DOCUMENTS

| | | | |
|---|---|---|---|
| 3,151,690 | 10/1964 | Grable | 175/321 |
| 3,439,757 | 4/1969 | Elenburg | 175/325.1 |
| 3,596,720 | 8/1971 | Elenburg | 175/215 |
| 4,274,497 | 6/1981 | Willis et al. | 175/100 |
| 4,509,606 | 4/1985 | Willis | 175/325.2 |
| 4,630,691 | 12/1986 | Hooper | 175/65 |
| 5,209,262 | 5/1993 | Carow et al. | 285/133.1 |

FOREIGN PATENT DOCUMENTS 2597150 10/1987 France .

*Primary Examiner*—Stephen J. Novosad
*Attorney, Agent, or Firm*—Burns, Doane, Swecker & Mathis, L.L.P.

[57] ABSTRACT

A drilling column has a percussive drilling head attached to a lower end thereof. The drilling column includes a skirt extending downwardly from a lower end thereof in surrounding relationship to the drilling head. The skirt is disposed in eccentric relationship to the drilling head, so that an enlarged space is formed at one side of the drilling head. An air duct arrangement extends through the drilling column for supplying compressed air to the drilling head. That compressed air exits the drilling head through a front face thereof and then flows upwardly through the enlarged space in the skirt and then travels through a discharge channel arrangement formed in the drilling column. In that way, cuttings entrained in the compressed air are removed upwardly from the drill hole. The drilling column is sealed-off with respect to the upper open end of the drill hole by a chuck pipe, enabling compressed air or liquid to be introduced from above ground into a gap surrounding the drilling column.

11 Claims, 2 Drawing Sheets

DRILLING COLUMN WITH SLEDGEHAMMER DRILLING HEAD

BACKGROUND OF THE INVENTION

The invention pertains to a drilling column with an air duct for the addition of compressed air to a sledgehammer drilling head, which drilling head has a percussion drilling crown on its lower end and a central connector with a compressed air feed opening on its upper end.

During use of sledgehammer drilling heads, the sledgehammer driven by compressed air is located at the deepest point in the drill hole. The compressed air required for the hammering process is fed through the drilling column consisting of a simple drilling pipe. The compressed air exits from the percussion drilling crown and flows towards the gound surface in the space between the drilled cavity wall and the drill column, whereby the drilled material is forced to the surface.

In order to reach and maintain the required flow velocity for the maintenance of the conveying effect, very high compressed air volumes must be fed. For example, in a drilling diameter of approximately 380 mm and a drill pipe diameter of approximately 150 mm, approximately 25–30 $m^3$ of compressed air must be applied; the required flow velocity of approximately 30 m/sec in the annulus between the drill pipe and the drilled column wall is thereby accomplished. To achieve this, compressors must work very hard, and they experience a very high energy usage of for example 100 liters of diesel fuel per hour. The operation of diesel motors to drive the compressors represent an elevated environmental load.

The task of the invention is thus to institute a drilling column with a sledgehammer drill head of the type named above such that a significant reduction of the energy usage is accomplished while using conventional sledgehammer drill heads.

SUMMARY OF THE INVENTION

This task is solved according to the invention by constructing the drilling column out of a drill pipe with a central feed channel, around which the air duct is located. Between the lower end of the drill pipe and the connector of the sledgehammer drilling head, a coupling piece is installed which has a discharge channel section which rims from the central discharge channel of the drill pipe to a lateral inlet port and which also has at least one air duct section running from the air duct of the drill pipe to the central connector of the sledgehammer drill head. In proximity to the lateral inlet port of the coupling piece, a skirt open to the bottom is installed eccentrically with respect to the drilling head.

The use of a well-known two-way drill pipe makes it possible to use the central conveying channel of the drill pipe for the removal of the drilled material by means of the supplied compressed air. Since the flow cross section of this central conveying channel is significantly smaller than that of the annulus between the drill pipe and the drill hole wall, a sufficient flow velocity required for the conveyance process is achieved with significantly smaller compressed air volumes. For example, the compressed air volume, and thereby the energy usage, can be reduced to half of that compared to the conventional process. Thereby, a significant protection of the environment can be achieved.

The compressed air required for the operation of the sledgehammer drill head is fed downwards inside the coupling piece to the central connector of the sledgehammer drill head from the air duct discharging from the perimeter. In this way, the sledgehammer drill head is located at the center of the drill column, which is required on the basis of the energy direction. Moreover, the compressed air addition is carded out centrally to the connector so that physical modifications to the sledgehammer drill head do not need to be made. Therefore conventional sledgehammer drill heads can be used without modification.

The skirt installed air-fight on the connector, which surrounds the drive portion of the sledgehammer drill head, is open to the bottom primarily in the region beneath the lateral inlet port of the coupling piece, in order to take up the drilled material immediately above the percussion drilling crown arising from the drilling process. The hydrostatic pressure normally arising in the drill hole pushes the drillings into the skirt open to the bottom, from where they proceed into an essentially unhindered flow channel in the central conveying channel of the drill pipe and conveyed to the surface.

Since the skirt is displaced eccentrically with respect to the sledgehammer drill head to the side of the inlet port the inlet cross section in the skirt is greatest beneath the inlet port of the coupling piece, and the total area between the sledgehammer and the drill hole wall can be used. Also, relatively large pieces of the drilled material can be thus removed without difficulty.

According to another advantageous manifestation of the invention idea, the drill pipe is sealed around the drill hole opening and the area between the drill pipe and the drill hole opening is connected to a feed line for compressed air and/or water. In this way it is possible to maintain an elevated pressure in the annulus surrounding the drill pipe, which assists in the influx of the drillings mixed with water and compressed air. The feed of water in the sealed area can be particularly helpful at the beginning of a drill process, if no groundwater is produced in the drill hole.

BRIEF DESCRIPTION OF THE DRAWING

In the following, preferred embodiment of the invention represented in the illustrations is explained in more detail. Shown are.

DETAILED DESCRIPTION OF A PREFERRED EMBODIMENT OF THE INVENTION

Figure 1:
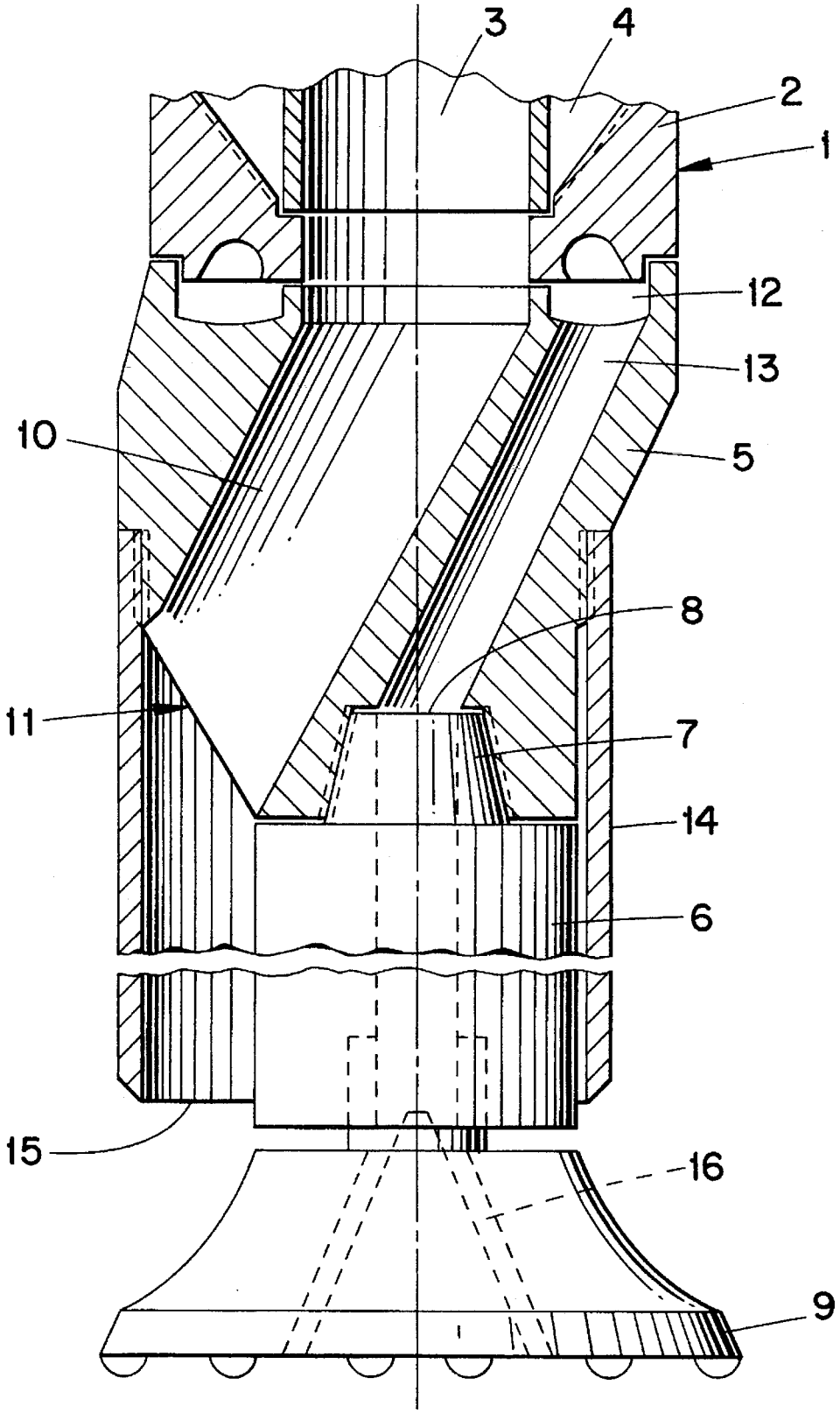
In FIG. 1, an elevation section through a sledgehammer drill head mounted at the lower end of a drill column according to the invention, and In FIG. 2, an elevation section through the sledgehammer drill head with the drill column located in a drill hole.

The drilling column 1, used in the depicted embodiment and carried by a drilling machine (not displayed), consists of a drill pipe 2 with a central discharge channel 3 and an air duct 4 surrounding it and is therefore characterized as a two-way drilling column.

At the lower end of the drill pipe 2, a coupling piece 5 is attached, preferably by being welded. A conventional sledgehammer drill head 6 has its central connector 7 screwed into the coupling piece 5 from below. The connector has a compressed air feed opening 8, which supplies compressed air to the sledgehammer drilling head 6 for operation of its percussion drilling crown 9. The diameter of the percussion drilling crown 9 is larger than that of the drill pipe 2, and also larger than the diameter of the drive portion of the sledgehammer drilling head 6.

Running inclined at an angle downwards through the inside of the coupling piece 5 is a section 10 of the discharge channel 3 leading to a lateral inlet port 11.

The air duct 4 of the drill pipe 2 discharges into a groove 12 formed on the face of the coupling piece 5 which concentrically surrounds the upper opening of the discharge channel section 10. An air duct section 13 runs from a radial position on this circular groove, which groove acts as a collecting manifold, steeply down to the central connector 7 of the drill head 6. As shown in the illustration, the air duct section 13 runs approximately parallel to the discharge channel section 10.

A skirt 14, open to the bottom, is attached to coupling piece 5. This skirt 14 is constructed of a pipe, open to the bottom, which is screwed onto the coupling piece 5 and is offset displaced eccentrically relative to the axis of the sledgehammer drill head 6, toward of the inlet port 11. In this way an inflow opening 15 is created to the side of the drill head 6 at a small distance above the percussion drilling crown 9. This opening is connected by way of the discharge channel section 10 to the discharge channel 3 in the drill pipe 2.

Figure 2:
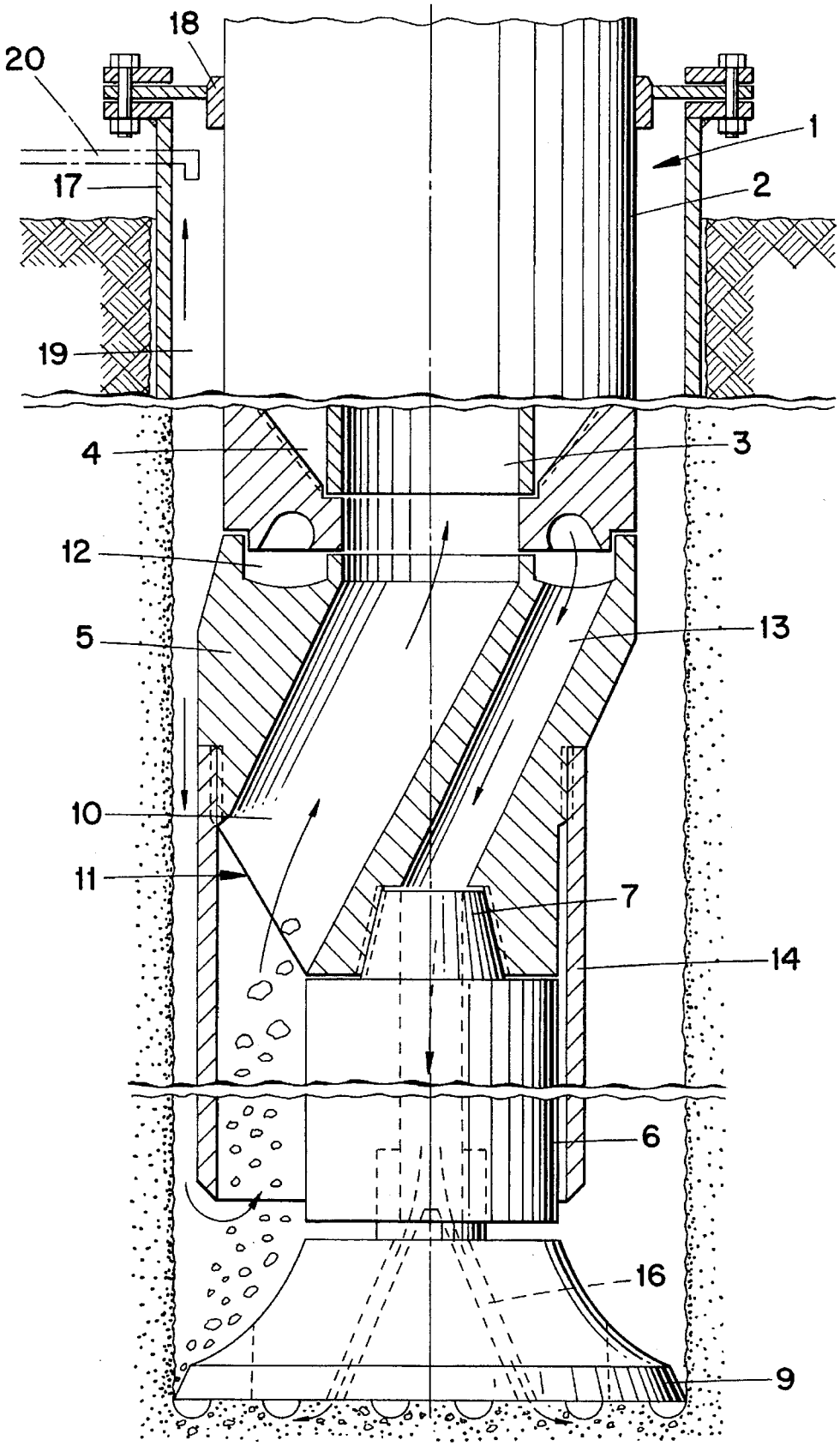

As shown in FIG. 2 with arrows, the compressed air flows through the air duct section 13 and the compressed air feed opening 8 of the central connector 7 into the sledgehammer drilling head 6 and drives the percussion drilling crown 9 in a hammering motion. At the same time, the entire drilling column 1 with the attached sledgehammer drill head 6 is turned by the drilling machine carrying it.

The compressed air exits through the air ducts 16 downward out of the percussion drilling crown 9 and carries the resultant drillings in the water-filled drill hole into the opening 15 of the skirt 14. The drillings are entrained and transported upward by means of the water-air-mixture flowing upward in the skirt 14, the discharge channel section 10 and the discharge channel 3.

It is shown in FIG. 2 that the drill pipe 2 is sealed off with respect to the drill hole opening. The drill hole opening is fitted with a chuck pipe 17 for this purpose, which is sealed against the drill pipe 2 by a rotating sliding packing 18.

In the gap 19 between the drill pipe 2 and the drill hole opening, a feed line 20 discharges (schematically dram in FIG. 2) compressed air and/or water. A pressure can thereby be maintained in this gap 19, which assists the discharge of the drillings into the skin 14. If no water arises in the drill hole still after the beginning section of a drill, water, which is required for the transport of the drillings through lifting action by means of the compressed air, can be fed through line 20.

Since the conveying section of the discharge channel is relatively small over the entire length of the drill, a sufficiently high discharge velocity can be maintained by the amount of the compressed air required to drive the sledgehammer drill head 6. There is no need to feed additional compressed air exclusively for the discharge of the drillings during additional use of energy.

Since a sufficient conveying effect is maintained for the drillings under all operating conditions, the drill floor remains clean, since none of the drillings in suspension can fall to the bottom. In this way, the drilling effect of the percussion drilling crown 9 is improved.

I claim:

1. A drilling column for supporting a percussive drilling head having a percussion crown on its lower end and a compressed air passage extending therethrough, said drilling column comprising:

a drill pipe having a first air supply duct and a first discharge channel extending downwardly therethrough;

a coupling piece including an upper end connected to a lower end of said drill pipe, and a lower end having a connector adapted for connection with a drilling head, a second air duct extending through said coupling piece and communicating at its upper end with said first air duct for supplying compressed air to the drilling head, a second discharge channel extending through said coupling piece and communicating at its upper end with said first discharge channel, a lower end of said second discharge duct being open to receive an upward flow of fluid to be discharged; and a skirt extending downwardly from a lower end of said coupling piece for surrounding at least an upper portion of the drilling head and forming a space communicating at its upper end with said second discharge duct, said skirt being open at its bottom end for receiving the fluid to be discharged, a center axis of said skirt being offset eccentrically with respect to said connector, said offset being in a direction toward a lower inlet end of said second discharge channel.

2. The drilling column according to claim 1, wherein said first discharge channel extends centrally through said drill pipe and is surrounded by said first air supply duct.

3. The drilling column according to claim 2, wherein said second discharge channel extends obliquely with respect to a center axis of said drill pipe, said lower inlet end of said second discharge channel disposed laterally outwardly with respect to said upper end of said second discharge channel.

4. The drilling column according to claim 3, wherein said second air supply duct extends generally parallel to said second discharge channel.

5. The drilling column according to claim 1 further including a chuck pipe disposed at an upper portion of said drill pipe and spaced laterally outwardly therefrom for forming a gap therebetween through which fluid can be downwardly fed.

6. A drilling installation disposed in a drill hole, comprising a drilling column supporting a percussive drilling head, said drilling head having a percussion crown on its lower end and a compressed air passage extending therethrough, said drilling column comprising:

a drill pipe having a first air supply duct and a first discharge channel extending downwardly therethrough;

a coupling piece including an upper end connected to a lower end of said drill pipe, and a lower end connected to said drilling head, a second air duct extending through said coupling piece and communicating at its upper end with said first air duct for supplying compressed air to drilling head, a second discharge channel extending through said coupling piece and communicating at its upper end with said first discharge channel, a lower end of said second discharge duct being open to receive an upward flow of fluid to be discharged; and a skirt extending downwardly from a lower end of said coupling piece and surrounding at least an upper portion of said drilling head, said skirt forming with said drilling head a space communicating at its upper end with said second discharge duct, said skirt being open at its bottom end for receiving the fluid to be discharged, a center axis of said skirt being offset eccentrically with respect to a center axis of said drilling head, said offset being in a direction toward a lower inlet end of said second discharge channel.

7. The drilling installation according to claim 6, wherein a gap is disposed around the outside of said drill pipe, said gap being sealed off with respect to an upper open end of the drill hole, a feed line communicating with said gap for introducing fluid into said gap.

8. The drilling installation according to claim 7 further including a chuck pipe for sealing off said gap with respect to the open end of the drill hole, said chuck pipe surrounding, and spaced laterally from, a portion of said drill pipe and extending coaxially with respect thereto.

9. The drilling column according to claim 8, wherein said first discharge channel extends centrally through said drill pipe and is surrounded by said first air supply duct.

10. The drilling column according to claim 9 wherein said second discharge channel extends obliquely with respect to a center axis of said drill pipe, said lower inlet end of said second discharge channel disposed laterally outwardly with respect to said upper end of said second discharge channel.

11. The drilling column according to claim 10, wherein said second air supply duct extends generally parallel to said second discharge channel.

* * * * *